United States Patent [19]

King et al.

[11] 4,105,911

[45] Aug. 8, 1978

[54] TRAVELLING WAVE TUBES

[75] Inventors: Robin Charles Moorhouse King; Maurice Esterson, both of Chelmsford, England

[73] Assignee: English Electric Valve Company Limited, England

[21] Appl. No.: 746,123

[22] Filed: Nov. 30, 1976

[51] Int. Cl.[2] ..... H01J 25/34

[52] U.S. Cl. ..... 315/3.5; 315/3.6; 315/39.3

[58] Field of Search ..... 315/3.5, 3.6, 39.3

[56] References Cited

U.S. PATENT DOCUMENTS

| | | | |
|---|---|---|---|
| 2,985,791 | 5/1961 | Bates et al. | 315/3.5 |
| 3,123,736 | 3/1964 | Christoffer et al. | 315/3.6 |
| 3,181,023 | 4/1965 | Hant et al. | 315/3.5 |
| 3,636,402 | 1/1972 | Horigome | 315/3.6 |
| 4,019,087 | 4/1977 | Hamada et al. | 315/3.6 |

*Primary Examiner*—Saxfield Chatmon, Jr.

[57] ABSTRACT

A coupled cavity travelling wave tube is disclosed which has a sever including a termination wedge, a sever pole piece with a drift tube and a termination cavity member defining a rectangular waveguide. Disposed in the rectangular waveguide are preformed projections which are provided so as to engage with the termination wedge, the termination wedge thereby being sandwiched between the projections and the sever pole piece.

8 Claims, 4 Drawing Figures

TRAVELLING WAVE TUBES

This invention relates to travelling wave tubes and more specifically to coupled cavity slow wave structure travelling wave tubes.

In a high gain travelling wave tube in which several amplifying sections, each consisting of a number of coupled cavities, are connected in series, instability occurs if the r.f. electromagnetic wave — often termed the circuit wave — travelling along the slow wave structure passes through too many sections. Each amplifying section, therefore, has a length, i.e., number of coupled cavities, appropriate for maximum stable gain with each section terminated in a matched load to prevent circuit wave reflections. Thus the tube is isolated (or "severed" as it is commonly termed) as regards the circuit wave between adjacent amplifying sections with the only coupling between the adjacent sections occurring by way of the electron beam which is velocity modulated by the circuit wave. This electron beam passes the length of the tube through a series of drift tubes, each provided between adjacent cavities.

It is known to achieve a substantially reflectionless termination by transforming the circularly sectioned waveguide cavities to a narrow height rectangular waveguide terminated in a waveguide load. By suitably choosing the material for the waveguide load, for example magnesium oxide loaded with silicon carbide, the load can be positioned inside the vacuum envelope of the tube thereby eliminating the requirement of an r.f. vacuum window. For further information regarding such severed travelling wave tubes, reference may be made to U.K. Pat. No. 969,291, suffice for it to be stated here, that for light-weight periodic permanent magnet focussed tubes it is most desirable to contain the sever loads within the confines of the periodic permanent magnet stack surrounding the slow wave cavities.

Figure 1:
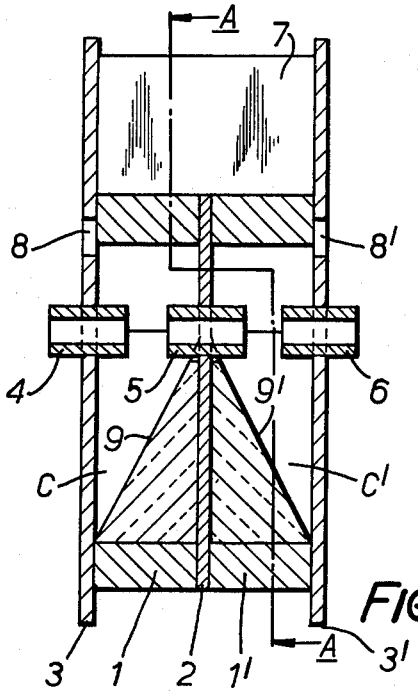
FIG. 1. PRIOR ART
Figure 2:
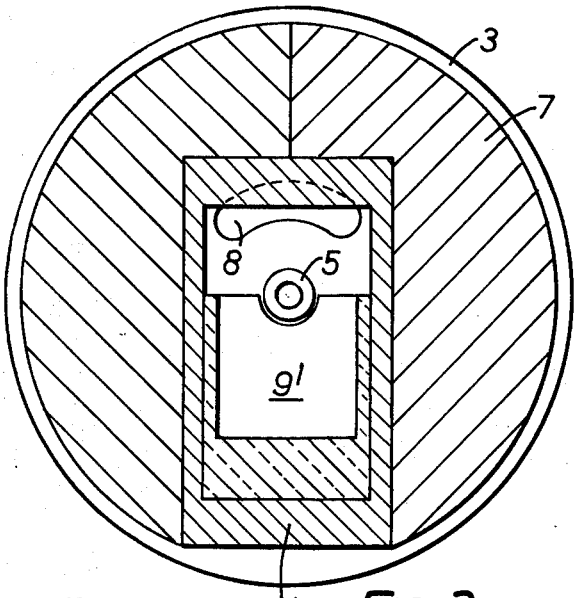
PRIOR ART FIG. 2.
Figure 3:
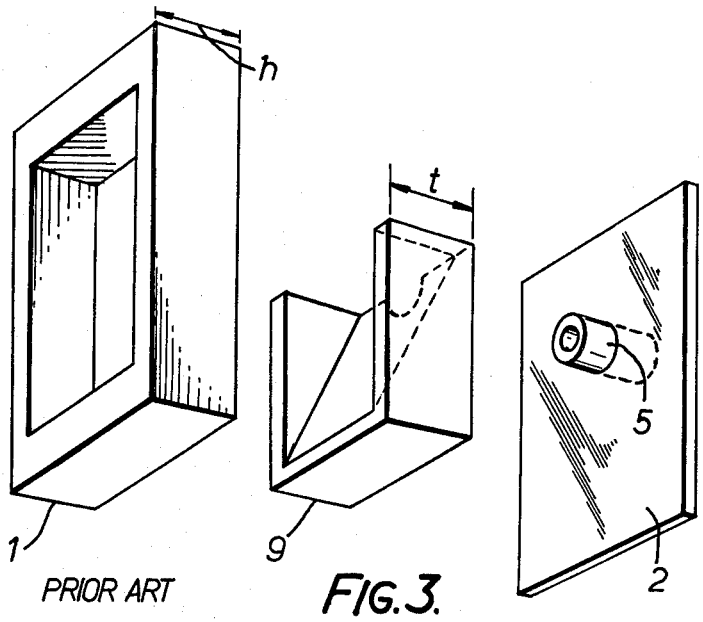
Figure 4:
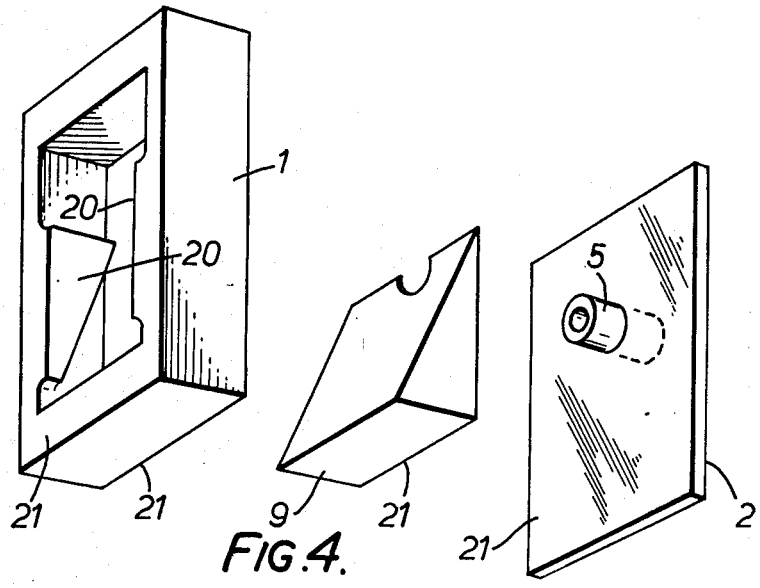

A currently used severed, or isolating, section of a coupled cavity travelling wave tube will now be described with reference to the accompanying drawings in which:

FIG. 1 shows a longitudinal section of a severed coupled cavity travelling wave tube in which only those parts necessary for an understanding of the present invention are displayed, FIG. 2 shows a section along the arrow headed lines A — A of FIG. 1, FIG. 3 shows a perspective view showing the detailed shapes of the elements for manufacturing one half of a severed section, and FIG. 4 is a perspective view of the detailed shapes for manufacturing a sever according to this invention.

In the Figures like references denote like parts.

The severed section of the coupled cavity travelling wave tube shown in FIGS. 1 and 2 has two narrow height rectangular waveguides defined by two copper termination cavity members 1, 1', each sandwiched between a rectangularly sectioned iron sever pole piece 2 and a circularly sectioned iron circuit pole piece 3,3' to form two cavities C and C'. The cavity C is the final cavity of an amplifying section for maximum stable gain.

An electron beam produced by an electron gun known per se (not shown) is arranged to be projected through circularly sectioned drift tubes 4, 5, 6 mounted in the pole pieces 2, 3 and 3' and focussed by a permanent periodic magnet 7 disposed around a major portion of both the termination cavity members 1, 1'. A circuit wave which is permitted to enter the cavity C through a coupling aperture 8, is prevented from passing to the cavity C', since no coupling aperture is provided in the sever pole piece 2, and is arranged to be substantially absorbed by a ceramic termination wedge 9. However, because the electron beam entering the cavity C will have been modulated by the circuit wave as it passes into the cavity C' it launches a new circuit wave which passes into a succeeding amplifying section through a coupling aperture 8' in the pole piece 3'. A further ceramic termination wedge 9' substantially absorbs any backward reflections of the newly launched circuit wave.

To enable the pole pieces 2, 3, 3' to be brazed to the termination cavity members 1, 1' the pole pieces are copper plated and the ceramic termination wedges 9, 9' are metallised by vapour depositing a layer of chromium and then a layer of copper as known per se. However, to manufacture a severed section the following criteria should be considered:

(1) The termination wedges 9, 9' must be brazed back to back on opposite sides of the sever pole-piece 2 to minimize distortion thereof.

(2) Because differing materials are employed, i.e., copper, iron and ceramic, all with differing coefficients of expansion it is undersirable that the severed section be heated to brazing temperature (approximately 820° C) on too many occasions. Thus the fewer the number of brazing operations the better.

(3) Although a supporting rod is positioned through the drift tubes 4, 5, 6 during assembly to maintain axial alignement, the rod is of necessity of small diameter and so liable to sag at the high brazing temperature involved and so the assembly should be brazed with the tube longitudinal axis vertical.

To satisfy conditions (1) and (3) one of the termination wedges must be held against gravity during the brazing operation, and to satisfy condition (2) it is not possible to insert a brazing fixture into the tube to support the termination wedges 9, 9' during brazing.

An arrangement by which the foregoing conditions are satisfied is shown in FIG. 3 in which it will be seen that the termination wedges 9, 9' are so shaped to fit inside the termination cavity members 1, 1' and to be held in position between the pole pieces 2, 3, 3'. Such an arrangement requires extremely accurate control of the termination wedge thickness dimension $t$ and the termination cavity member height dimension $h$, which must be equal at the brazing temperature to ensure good contact between the termination wedge 9, 9' and the sever pole-piece 3. Therefore at ambient temperature the ceramic termination wedge dimension $t$ is greater than the copper termination cavity member dimension $h$ and so, as the termination cavity members 1, 1' contract following brazing, the joint between the termination cavity members 1, 1' and the pole pieces 2, 3, 3' tends to fial.

The object of the present invention is to provide a severed coupled cavity travelling wave tube in which the tendency for the foregoing joint failure is reduced.

According to this invention in its broadest aspect a coupled cavity travelling wave tube has a sever which includes a termination wedge, a sever pole piece with a drift tube, and a termination cavity member defining a rectangular waveguide in which are disposed preformed projections provided to engage with said termination wedge, the termination wedge being sandwiched between said projections and the sever pole piece.

According to one aspect of this invention, a coupled cavity travelling wave tube has a sever which includes a termination wedge, a sever pole piece including a drift tube and a termination cavity member defining a rectangular waveguide in which are disposed preformed projections provided to engage the tapered surface of said termination wedge, the termination wedge being sandwiched between said projections and the sever pole piece.

Preferably, there are two wedge-shaped projections one positioned in each of the broad side walls of the waveguide defined by said termination cavity member, the slope of each wedge shaped projection being complementary to the shape of the termination wedge.

Preferably, two termination cavity members each defining a rectangular waveguide and each having projections provided to engage with a termination wedge are provided on opposite sides of said sever pole piece.

The invention will now be described, by way of example, with reference to FIG. 4 of the accompanying drawings which shows a perspective view of the detailed shapes for manufacturing a sever in accordance with this invention and which is one half of a severed section.

Like parts serving similar functions to those of the prior art have been given like reference numerals.

The termination cavity member 1, shown in FIG. 4, has two inwardly disposed projections 20 in the cavity member 1 broad walls which each have a portion which is complementary to the shape of the wedge termination 9, and the termination wedge 9 is sandwiched between the projection 20 and the sever pole piece 2. Prior to brazing, the sever pole piece side of the termination wedge is metallised by vapour depositing a layer of chromium and then a layer of copper as known per se and the surfaces designated 21 are coated with a brazing material consisting of silver, copper and a paladium. The ceramic termination wedge 9 is dimensioned so that, at the brazing temperature of approximately 820° C the copper termination cavity member 1 expands so that it is in contact with the iron sever pole piece 2. On cooling, the copper termination cavity member 1 contracts more than the ceramic termination wedge 9, but, as the copper is ductile, the projections 20, being relatively thin in cross-section, are compressed between the wedge 9 and the pole piece 3, and flow over the ceramic termination wedge without causing failure of the termination cavity member to sever pole piece joint whilst ensuring that the termination wedge is securely held. It may be noted that the effect of the projections 20 on the r.f. match may be compensated by adjusting the lengths of the drift tubes 4, 5, 6.

It has been found that the step of metallising the ceramic termination wedges 9, 9' may, if required, be eliminated since the wedges are mechanically held in position by the projections 20 and satisfactory heat transfer is ensured by the braze material flowing and substantially filling voids between the mating surfaces of the wedges 9, 9' and the pole piece 2.

We claim:

1. A coupled cavity travelling wave tube having a sever which includes a termination wedge, a sever pole piece, a drift tube in said pole piece and a termination cavity member defining a rectangular waveguide, said rectangular waveguide having an inner surface which bears projections, which projections are shaped and dimensioned to engage with said termination wedge whereby said termination wedge is sandwiched between said projections and said sever pole piece.

2. A coupled cavity travelling wave tube having a sever which includes a termination wedge with a cross-section in the shape of a right-angled triangle, a sever pole piece, a drift tube in said pole piece and a termination cavity member defining a rectangular waveguide having an inner surface which bears projections of ductile material which projections are shaped and dimensioned to engage the tapered hypotenuse surface of said termination wedge whereby said termination wedge is sandwiched between said projections and said sever pole piece.

3. A coupled cavity travelling wave tube as claimed in claim 2 wherein there are two wedge-shaped projections, one positioned in each of the broad side walls of the waveguide defined by said termination cavity member, the slope each wedge shaped projection being complementary to the slope of the hypotenuse of the termination wedge.

4. A coupled cavity travelling wave tube as claimed in claim 2 wherein two termination cavity members each defining a rectangular waveguide and each having projections provided to engage with a termination wedge are provided on opposite sides of said sever pole piece.

5. In a coupled cavity travelling wave tube having at least two amplifying sections and a sever section isolating said amplifying sections as regards the circuit wave, said sever section comprising a ductile termination cavity member having inner wall surfaces defining a cavity which passes from one side face of the cavity member to the opposite side face thereof, one of said amplifying sections including a circuit wave pole piece in face-to-face contact with and brazed to one side face of said termination cavity member and having a coupling aperture for the circuit wave opening into said cavity, said sever section also including a sever pole piece in face-to-face contact with and brazed to the opposite side face of said termination cavity member to close such side of the cavity insofar as the circuit wave is concerned and a lossy termination member accurately positioned in said cavity to absorb the circuit wave coupled thereinto through said aperture and being brazed in face-to-face contact with said sever pole piece, said termination member having a lower coefficient of thermal expansion than does said cavity member, the improvement which comprises:

a projection on at least one of said inner wall surfaces of the termination cavity member which projects into said cavity in overlapping relation to said termination member and sandwiches it against said sever pole piece whereby to achieve said accurate positioning of the termination member, said termination member being dimensioned with respect to its overlap with said projection and the spacing therefrom to said opposite side face of the cavity member such that at brazing temperature said cavity member expands to establish said face-to-face contact between said opposite side face and the sever pole piece and the thickness of said projection being such that, upon cooling from said brazing temperature, the ductility of said cavity member allows said projection to flow over said termination member to obviate failure of the brazed joint between said cavity member and said sever pole piece.

6. In a travelling wave tube as defined in claim 5 wherein said termination member is in the form of a wedge and two projections are formed on opposite inner wall faces of said cavity member, said projections engaging the inclined face of said wedge.

7. In a travelling wave tube as defined in claim 5 wherein said termination member fits snugly between opposite inner wall surfaces of said cavity member, one of which inner wall surfaces bears said projection.

8. In a travelling wave tube as defined in claim 7 wherein said termination member is in the form of a wedge and there are two projections, one on each of said opposite inner wall surface of the cavity member, which projections engage the inclined face of the wedge.

* * * * *

UNITED STATES PATENT AND TRADEMARK OFFICE

CERTIFICATE OF CORRECTION

PATENT NO. : 4,105,911

DATED : August 8, 1978

INVENTOR(S) : Robin Charles Moorhouse King et al

It is certified that error appears in the above-identified patent and that said Letters Patent are hereby corrected as shown below:

Insert the foreign application priority data as follows:

---[30] Foreign Application Priority Data

Great Britain appln. 49336/75 of December 2,1975.---

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*